US005433175A

United States Patent [19]

Hughes et al.

[11] Patent Number: 5,433,175

[45] Date of Patent: Jul. 18, 1995

[54] GENERATOR AIR FLOW AND NOISE MANAGEMENT SYSTEM AND METHOD

[75] Inventors: John C. Hughes, Coon Rapids; Steven R. Kuczenski, New Brighton; Anthony T. Klejeski, Bethel, all of Minn.

[73] Assignee: Onan Corporation, Minneapolis, Minn.

[21] Appl. No.: 159,357

[22] Filed: Nov. 30, 1993

[51] Int. Cl.[6] ..... F01P 3/22

[52] U.S. Cl. ..... 123/2; 123/198 E; 123/41.54; 181/204; 290/1 A

[58] Field of Search ..... 123/198 E, 2, 41.54; 181/204; 290/1 A, 1 B

[56] References Cited

U.S. PATENT DOCUMENTS 3,238,932 3/1966 Simpson ..... 123/41.54

4,495,901 1/1985 Nannini et al. ..... 290/7 A

FOREIGN PATENT DOCUMENTS 2-95759 4/1990 Japan ..... 123/2

*Primary Examiner*—Noah P. Kamen

*Attorney, Agent, or Firm*—Merchant, Gould, Smith, Edell, Welter & Schmidt

[57] ABSTRACT

An engine generator set apparatus including an internal combustion engine including a drive shaft driving an electrical generator, the engine and the generator being disposed along a longitudinal axis. A housing substantially enclosing the engine and generator, the housing including air inlets and air outlets. A fan drawing outside ambient air through the air inlets in the housing and along an inlet air pathway, the generator being axially disposed intermediate of the fan and the engine.

22 Claims, 7 Drawing Sheets

GENERATOR AIR FLOW AND NOISE MANAGEMENT SYSTEM AND METHOD

BACKGROUND OF THE INVENTION

The present invention relates to a generator air flow and noise management system and method.

Electrical generator sets are used in a number of applications wherein noise management and package size are primary concerns. One of these many applications is the Recreational Vehicle (RV) industry. RVs are frequently equipped with a generator set which has its own engine and generator which provides AC electrical power for the RV. Typically these generator sets are stored in a space beneath the floor of the RV. Often times they are supported on a platform which can be slid out to allow better access to the generator. Typically, the generator sets are enclosed within a housing which reduces their noise and protects them from their environment.

Because these generators are used in such close proximity to the living quarters inside the RV, it is important that they be as quiet as possible without taking up too much space or adding too much weight and without substantial additional cost. Many RV parking areas are also requiring more quiet units so that other campers are not disturbed. Of course it is always possible to make a generator set quieter by adding more noise isolation material to the housing enclosing the generator set. However, this increases the size and weight of the overall housing and adds substantially to the cost. Thus, there is a need for generator sets with reduced noise output without adding substantially to the size, weight, and cost of the generator set and its housing.

There is also a need for a generator set of reduced size since in RV and other applications, there is a minimal amount of space for the generator set. As noted above, generator sets are typically stored beneath the floor of an RV where there is very little space availability. Moreover, the increasing complexity and volume of auxiliary equipment being stored on RVs and other generator set installation sites is reducing the amount of space available for generator sets while increasing the power output requirements of generator sets. Thus, there is a need for generator sets which require less space without sacrificing their electrical power output capability and/or generator sets which have increased electrical output but require little or no additional space.

There is also a need for generator sets which are easy to install and service so as to reduce the cost of installation and facilitate servicing.

There is also a need for generator sets which have efficient cooling systems. Generator sets generate substantial heat during operation. There is a need for generator set cooling systems which provide for the efficient removal of this heat without adding substantially to the size, weight, noise, and cost of the generator set.

In addition to RVs, there are numerous other generator set applications which have some or all of the above noted concerns. For example, emergency vehicles are often equipped with generator sets for electrical power to the various emergency equipments present in the vehicle. Indeed many of these same concerns are present in most vehicle or portable generator set applications.

The present invention provides a generator set which solves many of the above noted problems associated with currently available generator sets.

SUMMARY OF THE INVENTION

The present invention relates to a generator air flow and noise management system and method.

The air flow and noise management system of the present invention includes a generator set enclosed within a housing. The housing being partitioned into different components to minimize noise.

In one embodiment of the air flow and noise management system, a heat sink is disposed in the inlet air pathway to facilitate removal of heat from the electronic components of the system.

In one embodiment of the invention there is provided an engine generator set apparatus including an internal combustion engine connected to an electrical generator by a drive shaft of the internal combustion engine, the engine and the generator being disposed along a longitudinal axis. A housing substantially encloses the engine and generator, the housing including air inlets and air outlets. A fan draws outside ambient air through the air inlets in the housing and along an inlet air pathway, the generator being axially disposed intermediate of the fan and the engine.

In one embodiment, a heatsink attached to control electronics in the housing, is disposed in the inlet air pathway so as to be cooled by the inlet air.

In one embodiment, a radiator is disposed with a major surface of the radiator facing substantially transversely of the longitudinal axis of the engine and the generator, the radiator being further located on a side of the generator opposite from the engine.

In one embodiment, the radiator cooperates with other partitions within the housing to form an area of pressurized air within the housing which is at a greater pressure than the ambient air outside the housing.

In one embodiment, the control electronics are disposed within the area of pressurized air.

In one embodiment, the area of pressurized air is disposed above the fan.

In one embodiment, an air deflection partition is disposed in the inlet air pathway in front of air flow inlet to the fan so as to deflect the incoming air toward the heatsink thereby increasing inlet air flow across the heatsink.

In one embodiment, the air inlets are disposed proximate the bottom of the housing.

In one embodiment, the air deflection partition extends from proximate the bottom of the housing upward at an oblique angle away from the fan whereby air is deflected upward toward the heatsink.

In one embodiment, a partition extends generally longitudinally of the housing so as to divide an interior of the housing into first and second compartments, the engine and the generator being disposed in the first compartment and the air outlets being disposed in an outer wall of the second compartment.

In one embodiment, a radiator is disposed in the partition whereby air flows through the radiator from the first compartment to the second compartment.

In one embodiment, the engine is water cooled, a flexible coolant fill tube having a pressure cap at its coolant fill end being interconnected to a coolant reservoir of the water cooled engine, the fill tube having a length sufficient to extend above the top of the housing when fully extended.

In one embodiment, a mounting means is provided for attaching the fill tube to housing when not in use.

In one embodiment, the housing includes a side panel being pivotally mounted to allow pivotal movement of a top portion of the side panel away from the housing so as to allow access to the coolant fill tube.

These and various other advantages and features of novelty which characterize the present invention are pointed out with particularity in the claims annexed hereto and forming a part hereof. However, for a better understanding of the present invention, its advantages, and other objects obtained by its use, reference should be made to the drawings which form a further part hereof, and to the accompanying descriptive matter, in which preferred embodiments of the present invention are illustrated and described.

BRIEF DESCRIPTION OF THE DRAWINGS

Referring now to the drawings wherein like reference numerals generally indicate corresponding parts throughout the several views.

DETAILED DESCRIPTION OF A PREFERRED EMBODIMENT OF THE INVENTION

Figure 1:
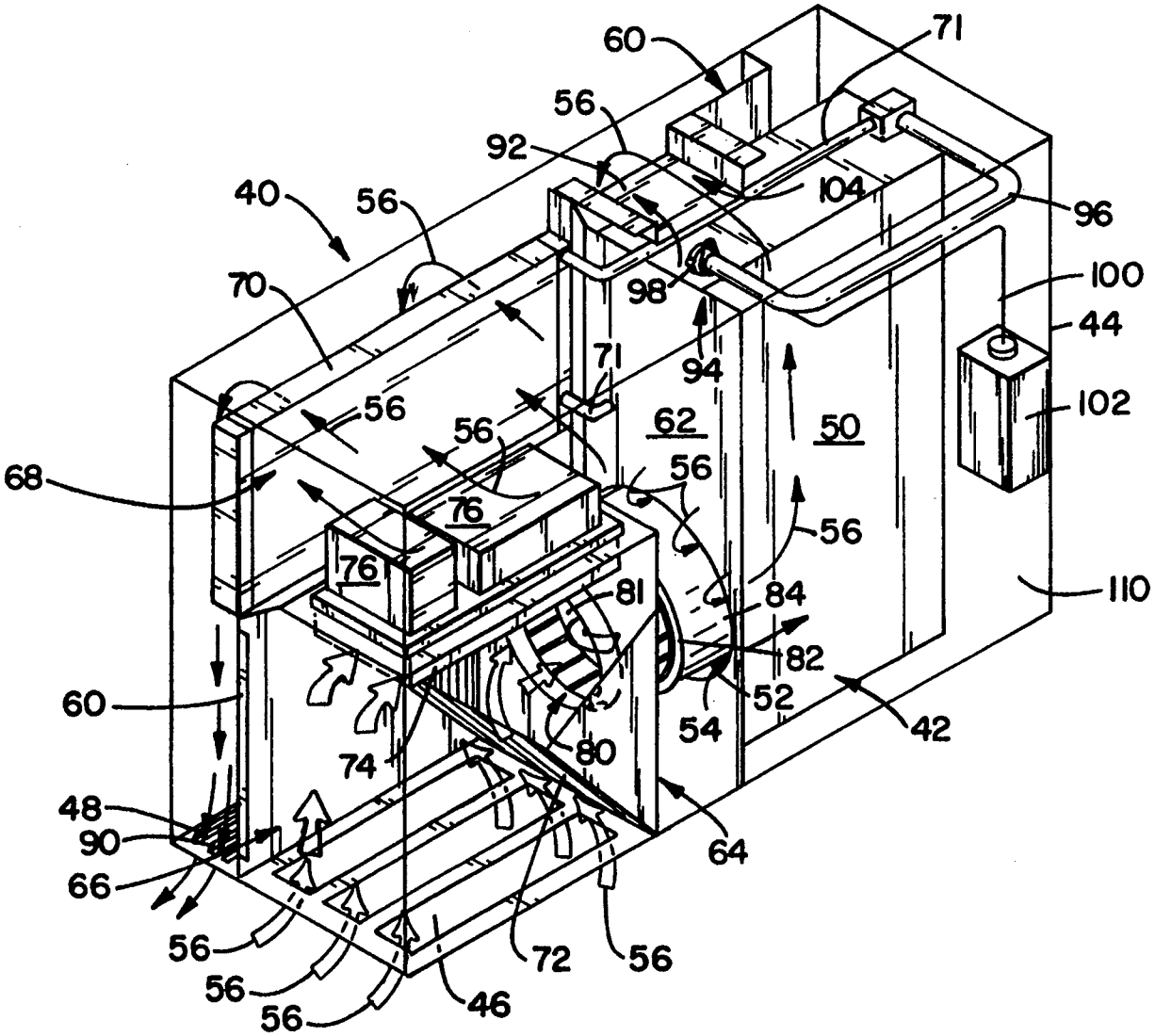
FIG. 1 is a diagrammatic perspective view of an embodiment of a generator set generally in accordance with the principles of the present invention illustrating the air flow path and relative location of the generator set components within a housing enclosing the generator set.

Referring now to the figures there is illustrated a preferred embodiment of a generator air flow and noise management system, designated by the reference numeral 40, generally in accordance with the principles of the present invention. The embodiment shown includes a generator set 42 enclosed within a housing 44. The housing 44 includes air inlets 46 and air outlets 48. The generator set 42 includes a water cooled combustion engine 50 whose drive shaft (not shown) drives a generator 52. An air circulating fan 54 is affixed to the generator 52 on a side of the generator 52 opposite from the engine 50 for circulating air through an interior of the housing 44. The air flow through the interior of the housing 44 is generally indicated by arrows 56.

As illustrated in FIG. 1, the interior of the housing is partitioned into various compartments. A first partition 60 extends generally longitudinally of the housing 44 so as to generally divide the housing 44 into two longitudinally extending compartments. The air inlets 46 are disposed on one side of the first partition 60 and the air outlets 48 are disposed on an opposite side of the first partition 60. Moreover the generator set 42 is located on a side of the first partition 60 opposite the side containing the air outlets 48.

The side of the first partition 60 containing the generator set 42 is further generally divided into two compartments by a transversely extending second partition 62. The engine 50 is disposed on one side of the second partition and the fan 54 is disposed on an opposite side of the partition.

The side of the partition 62 on which the fan is located is further generally divided by a third partition 64 into an air inlet pathway 66 and a compartment 68 containing air at a greater pressure than the ambient air. Air is drawn in through the air inlets 46 and along the inlet air pathway 66 to the fan 54. The fan 54 forces the air into the pressurized air compartment 68 and into the compartment on the other side of the second partition 62 including the engine 50.

Figure 2:
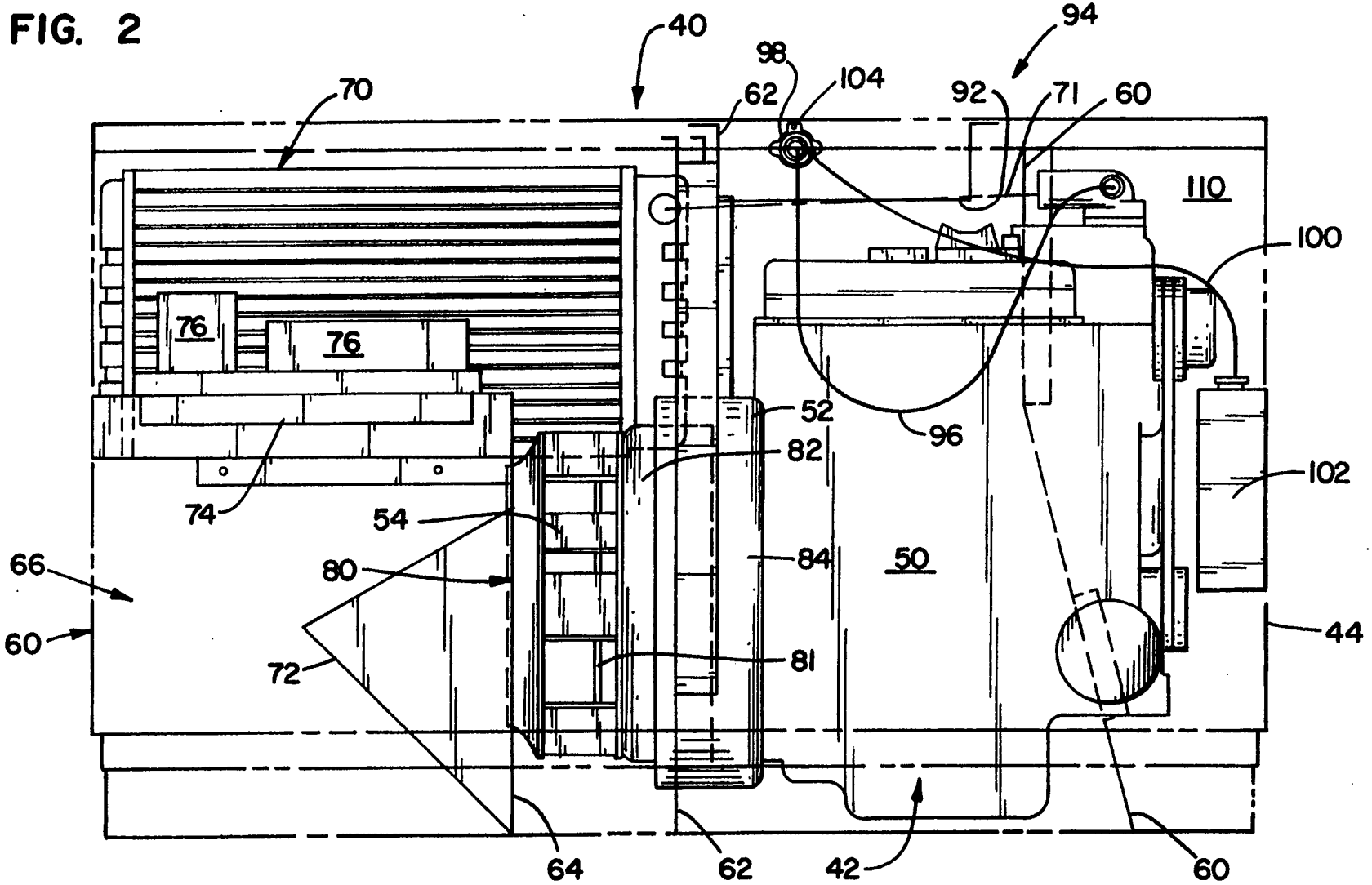
FIG. 2 is a diagrammatic side elevational view of the embodiment shown in FIG. 1.

As illustrated in FIGS. 1 and 2, a liquid cooled radiator 70 is disposed in the first partition 60 to form at least a part of the first partition 60 adjacent the pressurized air compartment 68. The radiator 70 is suitable interconnected by fluid tubing 71 to the liquid coolant system of the engine. The radiator 70 allows air flow therethrough but restricts the air flow such that there is a buildup of air pressure in the compartment 68. As illustrated, a major surface of the radiator 70 faces transversely of a longitudinal axis of the generator set 42 and is generally parallel to the first partition 60.

Figure 3:
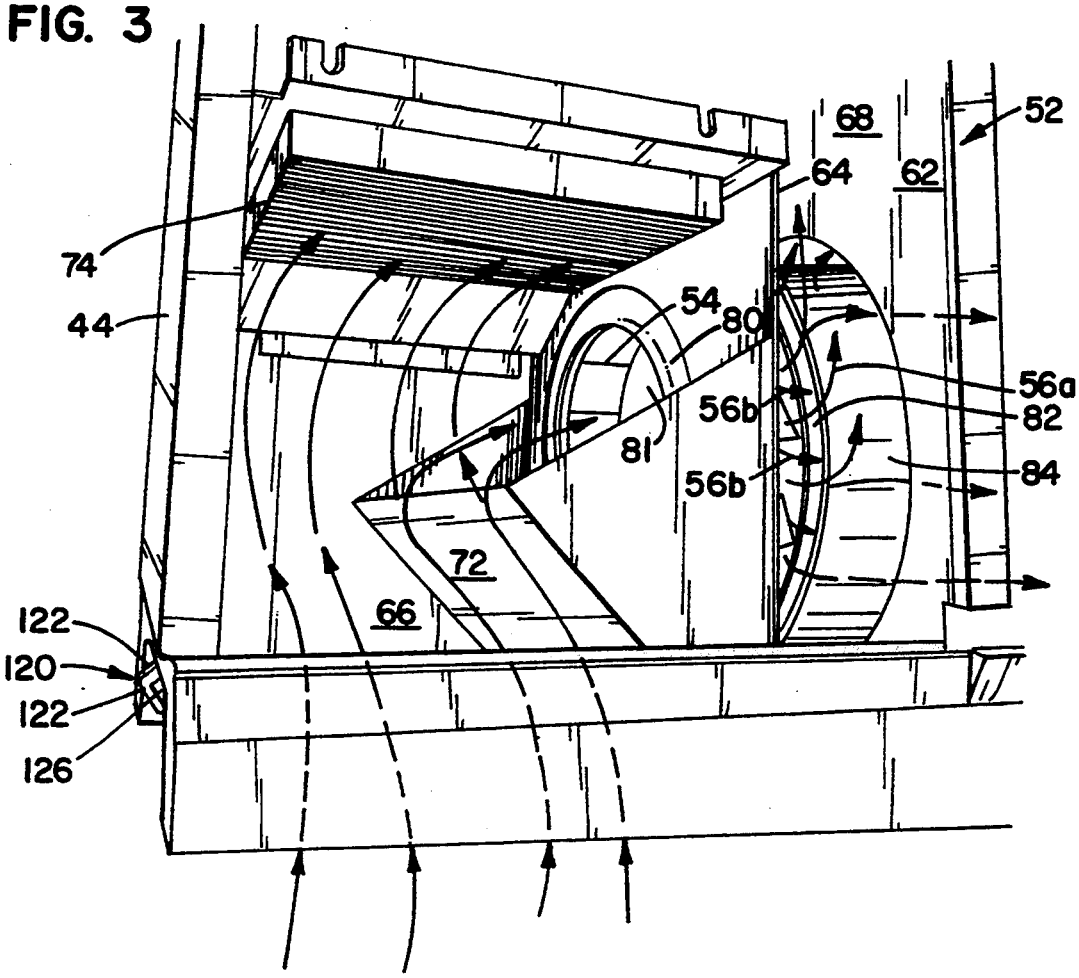
FIG. 3 is a partial perspective view of the air inlet path illustrating an embodiment of a heat sink disposed in the air inlet path and an embodiment of an air flow deflection partition disposed in front of a fan of the generator set.
Figure 10:
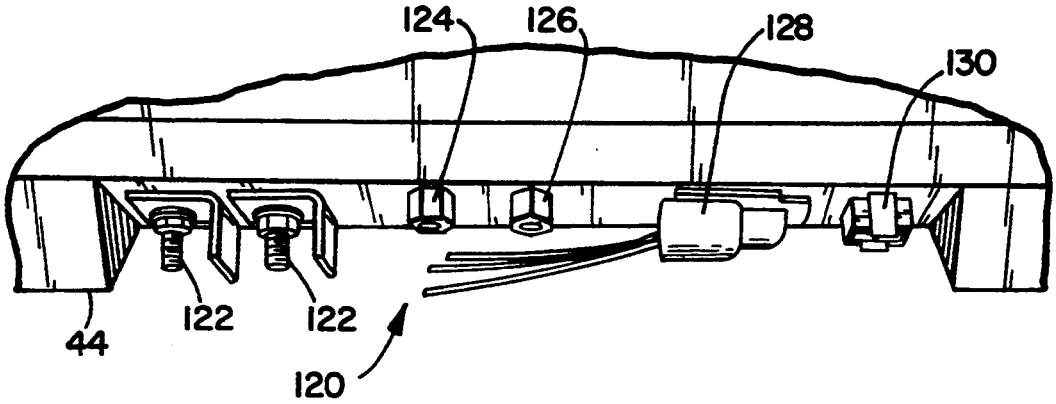
FIG. 10 is a diagrammatic perspecitve view of an interface connect panel providing terminals for electrical and fuel connection of the generator set.
Figure 6:
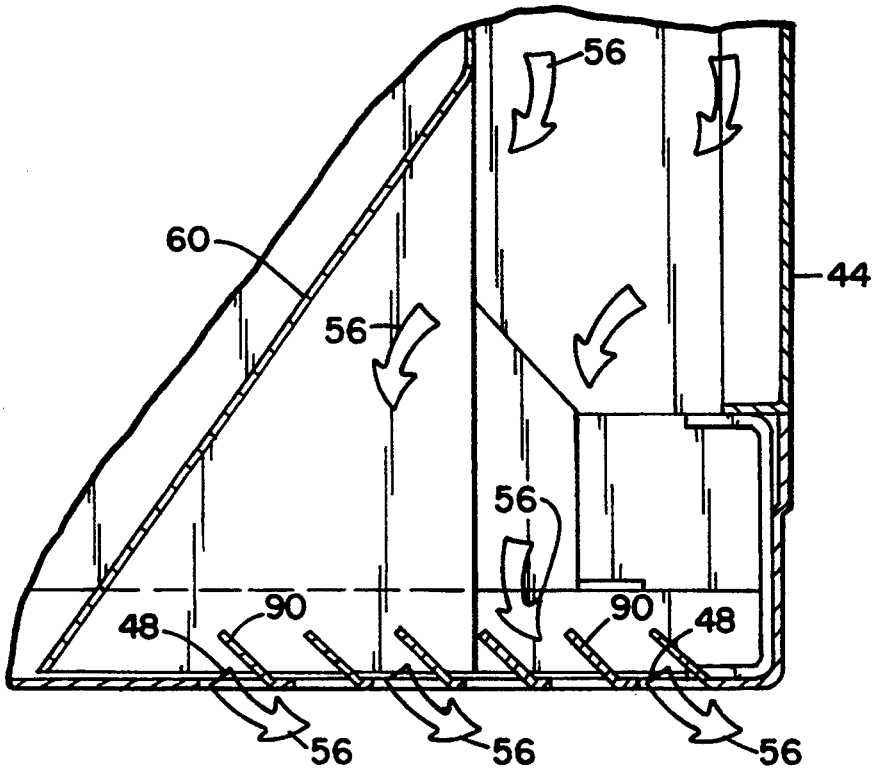
FIG. 6 is a partial sectional view illustrating louvered air outlets in a bottom wall of the housing.
Figure 4:
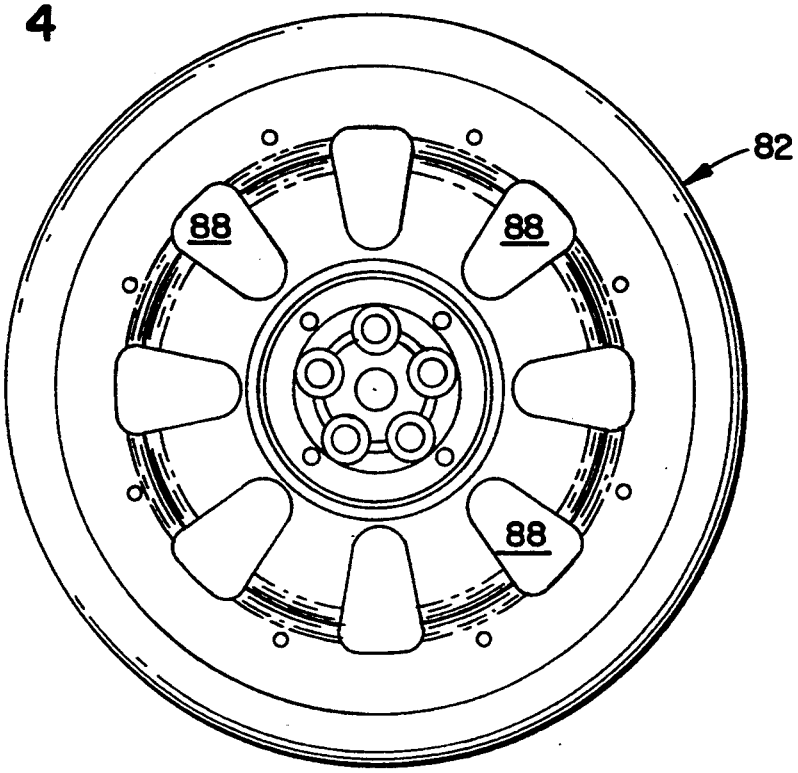
FIG. 4 is an elevational view of the generator rotor/-flywheel.
Figure 5:
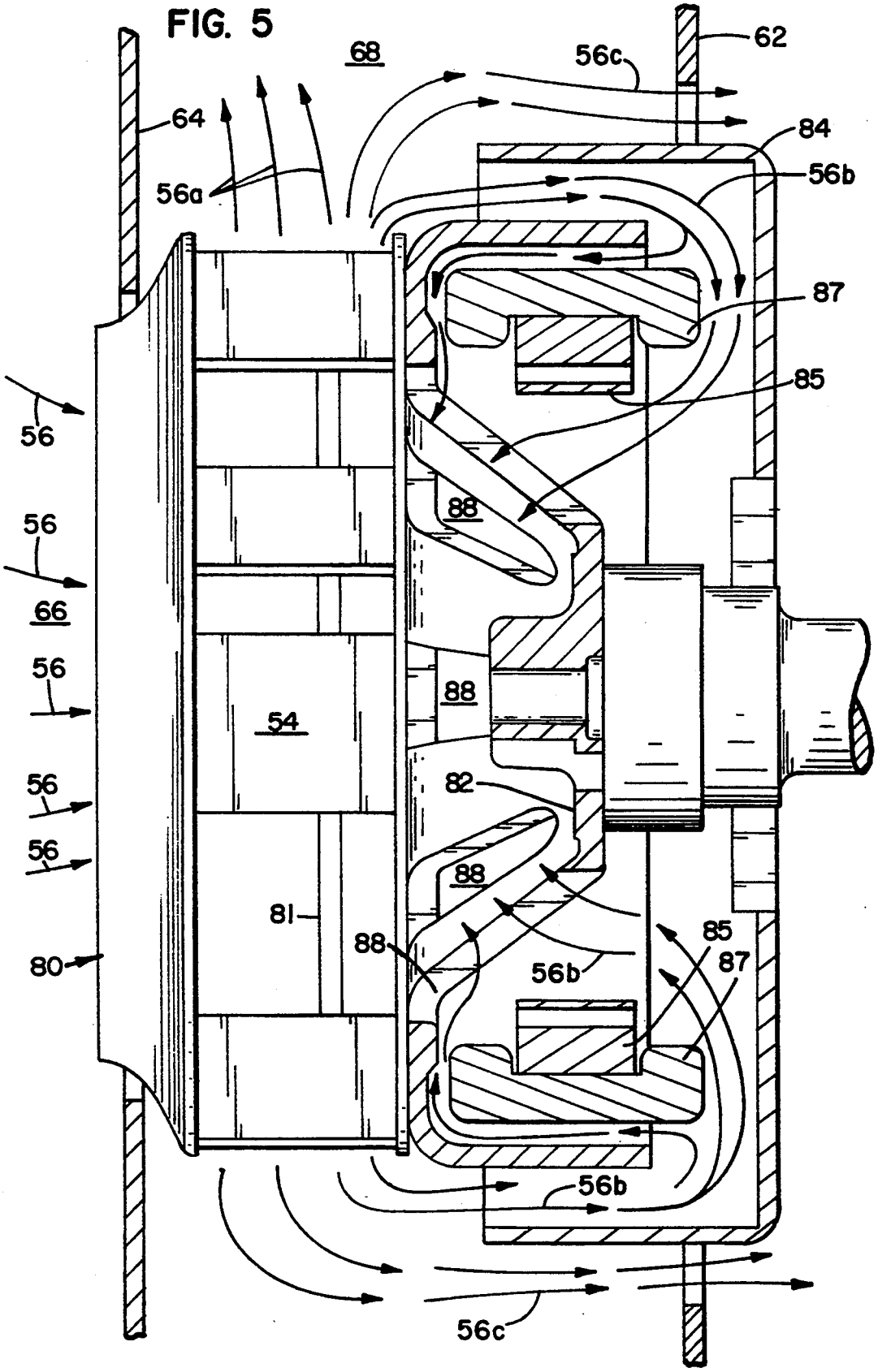
FIG. 5 is an enlarged, partial sectional view of the fan attached to the generator.
Figure 8:
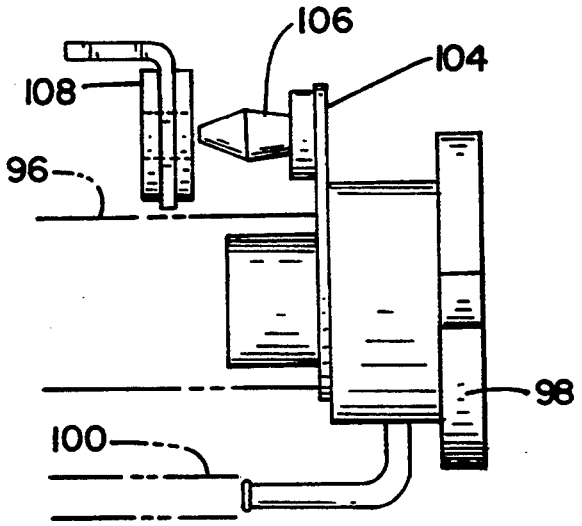
FIG. 8 is a partial exploded view illustrating the flexible coolant fill assembly and a retaining member disposed on the housing for retaining the flexible coolant fill assembly in the housing in a stored position.

As illustrated in FIGS. 1–3, an air deflection partition 72 extends upward from proximate a bottom of the housing 44 and away from the fan 54. In addition, the embodiment of the partition 72 shown includes to vertically extending side members. The air deflection partition 72 forces air incoming through the air inlets 46 upward and away from the fan.

In the embodiment shown, a heat sink 74 is disposed proximate a top portion of the inlet air pathway 66. The heat sink 74 is connected to generator set control electronics 76 disposed in the pressurized air compartment 68. Accordingly, the air deflection partition 72 forces incoming ambient air up toward the heat sink 74 such that the incoming ambient air generally flows across the heat sink 74 to facilitate transfer of heat from the heat sink 74 to the incoming air and thus cool the control electronics 76.

Referring now to FIGS. 1–5, there are shown additional details of a fan/generator arrangement in accordance with the principles of the present invention. The fan 54 has a housing 80 which is attached to a rotor 82 of the generator 52 which rotates about a stator 85 having coils 87. In the embodiment shown the generator 52 is a variable speed, permanent magnet alternator (PMA). A baffle 81 is disposed transversely of the housing 80 to restrict the flow of air through the housing 80. As illustrated by arrows **56*a* in FIG. 5, much of the air is circulated by the fan 54 into the pressurized air compartment 68. Yet other air, represented by arrows 56***b*, is circulated across the coils 87 of the generator 52 and then back out vents 88 (see FIG. 4) into the fan 54 through openings in the baffle 81. Still other air, as represented by arrows 56*c*, is circulated from the pressurized air compartment 68 into the compartment containing the engine 50 through a gap formed between a generator housing 84 and the partition 62.

As illustrated in FIGS. 1–6, the air outlets 48 include louvers 90 which serve to direct outlet air away from the housing 44 and which provide a partition blocking noise transmission through the air outlets 48. Moreover, the first partition 60 is inclined, proximate its bottom, to extend generally toward the engine. An air flow pathway is provided by a bracket 92 proximate a top portion of the partition 60 adjacent the engine so as to allow air flow from the compartment on the engine side of the first partition 60 to the other side of the partition 60.

Referring now to FIGS. 1–8, the preferred embodiment of the present invention includes a flexible coolant fill system 94 which facilitates access to fill the coolant system of the engine with coolant. The flexible coolant fill system 94 includes an flexible fill tube 96 having a fluid pressure cap 98 and a flexible coolant overflow tube 100 which is connected to an overflow reservoir 102. When not in use the flexible fill tube 96 is attached to a top portion of the housing 44 by a fastener 104. In the embodiment shown, a first portion of the fastener 104 is attached to an end of the flexible fill tube 96 and a second portion is mounted to an inside surface at the top of the housing 44. The first portion includes an insert 106 and the second portion includes a member 108 for receiving the insert 106 so as to form a snap like fastener.

Figure 7:
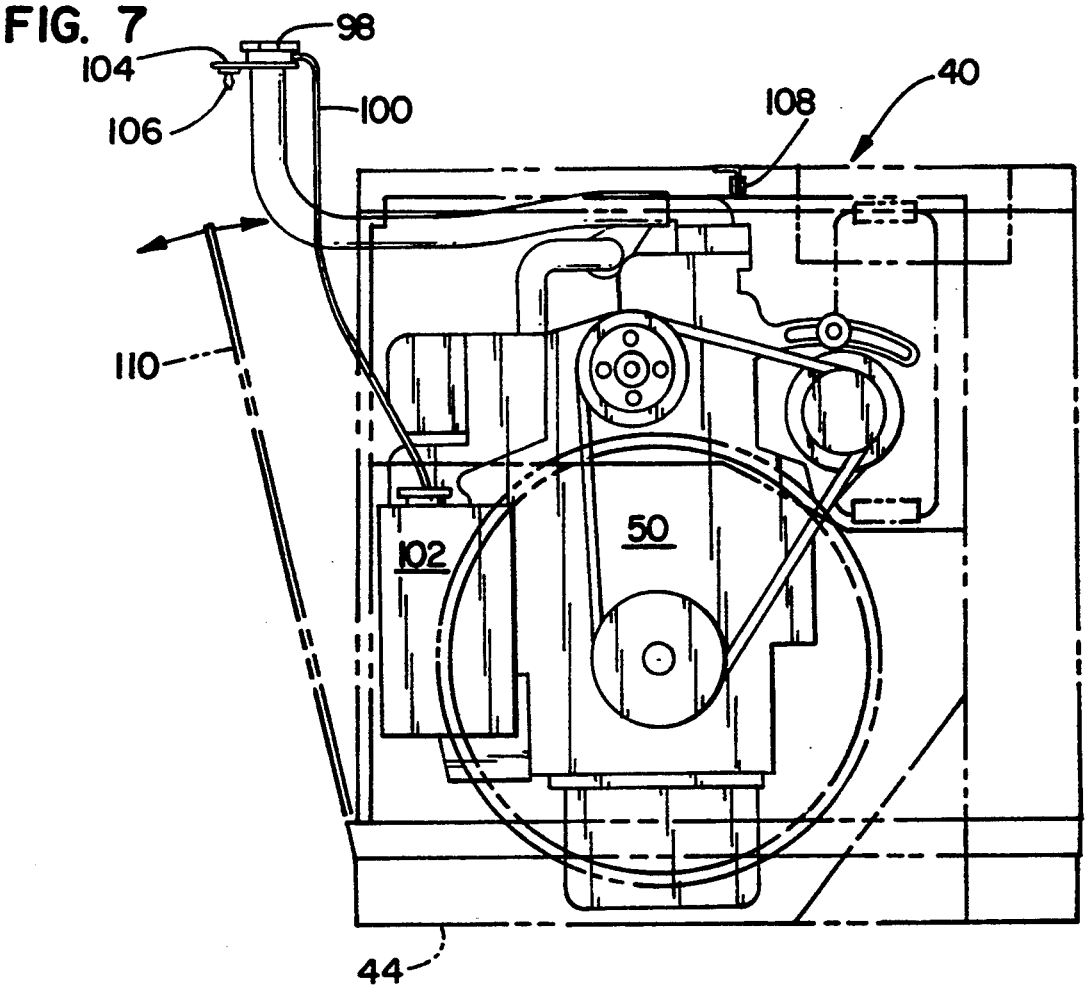
FIG. 7 is a diagrammatic front end elevational view of an engine of the generator set illustrating a flexible coolant fill assembly incorporating a fluid pressure cap, a side panel of the housing being pivoted away from the housing and the flexible coolant fill assembly being extended out the opening created by the side panel and extended upward into a coolant fill position.

A side panel 110 is pivotally mounted to allow access to the flexible fill tube 96 whereby the end of the fill tube can be removed from the housing as generally indicated in FIG. 7 to allow coolant to be added to the coolant system.

An interface panel 120 is disposed proximate a bottom of the housing 44 at the end of the housing adjacent the air inlets 46. The panel includes two battery terminals 122, a fuel inlet connector 124, a fuel outlet connector 126, a power outlet terminal 128, and a remote start electrical terminal 130. Accordingly, the generator set 42 can be interconnected without having to gain access to the inside of the housing 44.

In one embodiment of the present invention an engine exhaust outlet 138 is provided in the bottom of the housing 44.

Figure 9:
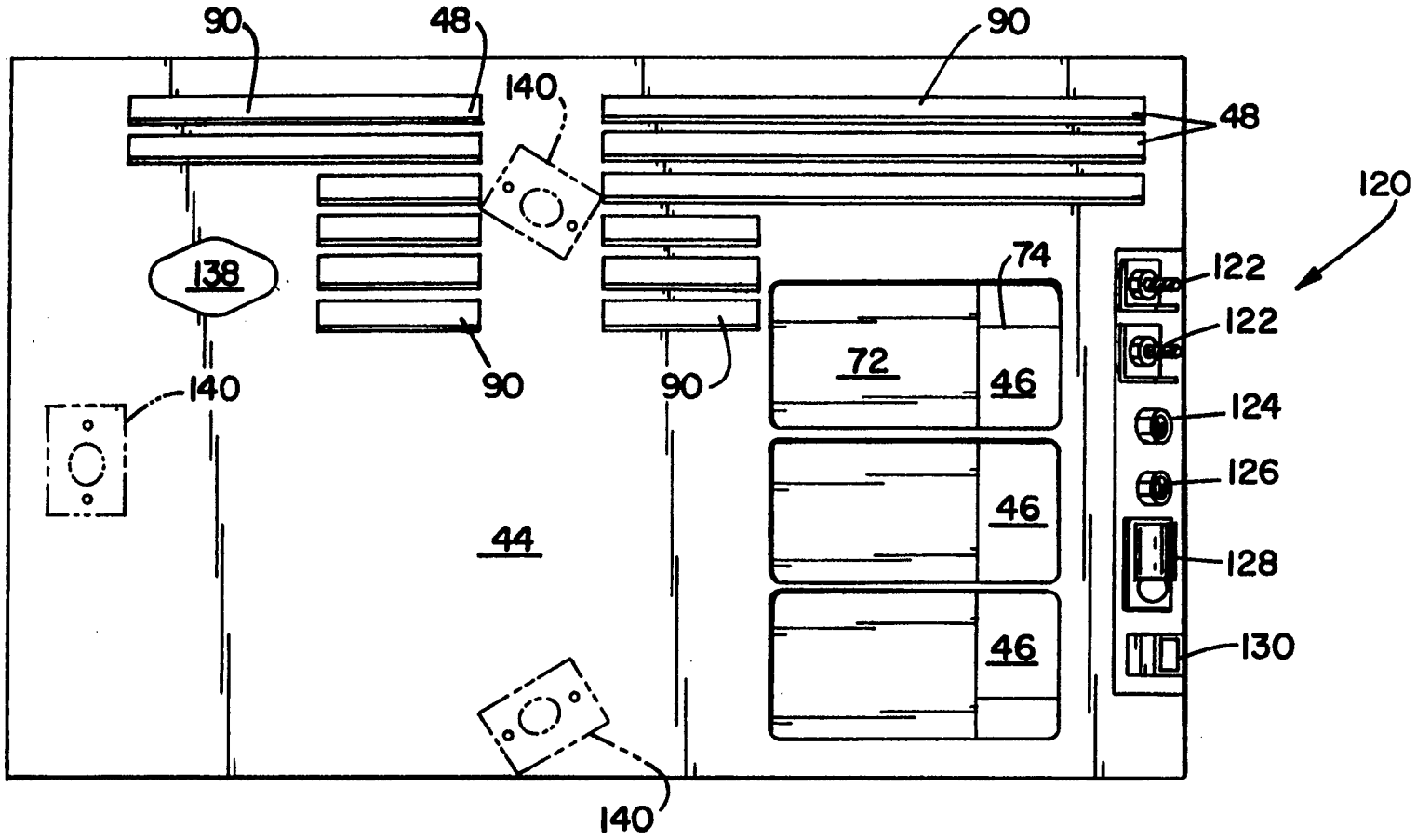
FIG. 9 is a diagrammatic bottom plan view of the generator set housing.

In one embodiment a three point mount is used to mount the engine to the bottom of the housing 44 at three diffent locations 140 as shown in FIG. 9.

The present invention has particular utility for recreational vehicle (RV) applications although it may be used in numerous other applications where an electrical generator is required. Because of its relatively small size the present invention can be readily mounted under the floor of an RV. Many RVs have an area beneath their floor which is referred to as their basement. The present invention enables a generator set and its housing to be mounted on a platform which can be readily slid out from under the RV to allow servicing of the generator set. Once slid out from under the RV, the generator set can be readily serviced. The interface panel 120 allows quick hook-up to the RV systems. The flexible coolant fill system 94 allows refilling with coolant simply by pivoting out the side panel and pulling out the flexible fill tube 96.

The various partitions within the housing 44 block the direct transmission of noise to the outside. Moreover, the partitioning of the housing 44 such that the outlets are separated from the generator set 42 further reduces noise transmission. With the air inlets 46 and the air inlets 48 disposed in the bottom of the housing, any noise which does escape via the air inlets 46 and the air outlets 48 will be directed downward and away from the RV living space.

In addition components are arranged in the housing 44 to minimize the physical dimensions of the housing 44 and reduce noise.

It will be appreciated that any number of different generator sets might be used in keeping with the principles of the invention. In one embodiment providing 6.5 to 7.5 kW of output, the generator set is powered by a KUBOTA, three cylinder water cooled diesel D722 engine and has a permanent magnet, variable speed alternator (PMA).

In one embodiment the generator set 42 will have a noise level of 80–83 decibels and more preferably 72–80 decibels.

It is to be understood that even though numerous characteristics and advantages of the present invention have been set forth in the foregoing description, together with details of the structure and function of the invention, the disclosure contained herein is illustrative, and changes in matters of order, shape, size and arrangement of parts and of steps may be made within the principles of the present invention and to the full extent indicated by the broad general meaning of the terms in which the appended claims are expressed. The disclosures of the cited references are incorporated by reference herein.

What is claimed is:

1. An engine generator set apparatus, comprising:

an internal combustion engine including a drive shaft;

an electrical generator driven by the drive shaft of the internal combustion engine, a longitudinal axis being defined through the drive shaft, the generator being disposed along the longitudinal axis;

a housing substantially enclosing the engine and generator, the housing including air inlets and air outlets;

a fan drawing outside ambient air through the air inlets in the housing and along an inlet air pathway, the generator being axially disposed intermediate of the fan and the engine;

a heatsink attached to control electronics being disposed in the inlet air pathway and a radiator disposed with a major surface of the radiator facing substantially transversely of the longitudinal axis of the engine and the generator.

2. An apparatus in accordance with claim 1, wherein the radiator cooperates with other partitions within the housing to form an area of pressurized air within the housing which is at a greater pressure than the ambient air outside the housing.

3. An apparatus in accordance with claim 2, wherein the control electronics are disposed within the area of pressurized air.

4. An apparatus in accordance with claim 2, wherein the area of pressurized air is disposed above the fan.

5. An apparatus in accordance with claim 1, wherein an air deflection partition is disposed in the inlet air pathway in front of the fan so as to deflect the incoming air toward the heatsink, which is located in front of and above the fan, thereby increasing inlet air flow across the heat sink.

6. An apparatus in accordance with claim 5, wherein the air inlets are disposed proximate the bottom of the housing.

7. An apparatus in accordance with claim 6, wherein the air deflection partition extends from proximate the bottom of the housing upward at an oblique angle away from the fan whereby air is deflected upward toward the heatsink.

8. An apparatus in accordance with claim 1, where a partition extends generally longitudinally of the housing so as to divide an interior of the housing into first and second compartments, the engine and the generator being disposed in the first compartment and the air outlets being disposed in an outer wall of the second compartment.

9. An apparatus in accordance with claim 8, further including a radiator disposed in the partition whereby air flows through the radiator from the first compartment to the second compartment.

10. An apparatus in accordance with claim 1, wherein the engine is liquid cooled, a flexible coolant fill tube having a pressure cap at its coolant fill end being interconnected to a coolant reservoir of the water cooled engine, the fill tube having a length sufficient to extend above the top of the housing when fully extended.

11. An apparatus in accordance with claim 10, further including a mounting means for attaching the fill tube to housing when not in use.

12. An apparatus in accordance with claim 10, wherein the housing includes a side panel being pivotally mounted to allow pivotal movement of a top portion of the side panel away from the housing so as to allow access to the coolant fill tube.

13. An engine generator set apparatus, comprising:

an internal combustion engine including a drive shaft;

an electrical generator driven by the drive shaft of the internal combustion engine, a longitudinal axis being defined through the drive shaft, the generator being disposed along the longitudinal axis;

a housing substantially enclosing the engine and generator, the housing including air inlets and air outlets;

a fan drawing outside ambient air through the air inlets in the housing and along an inlet air pathway, the generator being axially disposed intermediate of the fan and the engine; and a radiator disposed with a major surface of the radiator facing substantially transversely of the longitudinal axis of the engine and the generator.

14. An apparatus in accordance with claim 13, wherein the engine is water cooled, a flexible coolant fill tube having a pressure cap at its coolant fill end being interconnected to a coolant reservoir of the water cooled engine, the fill tube having a length sufficient to extend above the top of the housing when fully extended.

15. An apparatus in accordance with claim 13, wherein the radiator cooperates with other partitions within the housing to form an compartment of pressurized air within the housing which is at a greater pressure than the ambient air outside the housing.

16. An apparatus in accordance with claim 15, wherein the control electronics are disposed within the area of pressurized air.

17. An apparatus in accordance with claim 16, wherein the area of pressurized air is disposed above the fan.

18. An apparatus in accordance with claim 13, wherein an air deflection partition is disposed in the inlet air pathway in front of the fan so as to deflect the incoming air toward the heatsink, which is located in front of and above the fan, thereby increasing inlet air flow across the heatsink.

19. An apparatus in accordance with claim 13, where a partition extends generally longitudinally of the housing so as to divide an interior of the housing into first and second compartments, the engine, fan and the generator being disposed in the first compartment and the air outlets being disposed in an outer wall of the second compartment, the radiator being disposed in the partition whereby air flows through the radiator from the first compartment to the second compartment.

20. An engine generator set apparatus, comprising:

an internal combustion engine including a drive shaft;

an electrical generator driven by the drive shaft of the internal combustion engine, a longitudinal axis being defined through the drive shaft, the generator being disposed along the longitudinal axis;

a housing substantially enclosing the engine and generator, the housing including air inlets and air outlets;

a fan drawing outside ambient air through the air inlets in the housing and along an inlet air pathway, the generator being axially disposed intermediate of the fan and the engine;

a heatsink attached to control electronics being disposed in the inlet air pathway; and an air deflection partition is disposed in the inlet air pathway in front of air flow inlet to the fan so as to deflect the incoming air toward the heatsink thereby increasing inlet air flow across the heatsink.

21. An engine generator set apparatus, comprising:

an internal combustion engine including a drive shaft;

an electrical generator driven by the drive shaft of the internal combustion engine, a longitudinal axis being defined through the drive shaft, the generator being disposed along the longitudinal axis;

a housing substantially enclosing the engine and generator, the housing including air inlets and air outlets;

a fan drawing outside ambient air through the air inlets in the housing and along an inlet air pathway, the generator being axially disposed intermediate of the fan and the engine;

a heatsink attached to control electronics being disposed in the inlet air pathway;

a radiator disposed above and to the side of the fan; and a partition extending generally longitudinally of the housing so as to divide an interior of the housing into first and second compartments, the radiator forming part of the partition extending longitudinally of the housing, the engine and the generator being disposed in the first compartment and the air outlets being disposed in an outer wall of the second compartment.

22. An engine generator set apparatus, comprising:

an internal combustion engine including a drive shaft;

an electrical generator driven by the drive shaft of the internal combustion engine, a longitudinal axis being defined through the drive shaft, the generator being disposed along the longitudinal axis;

a housing substantially enclosing the engine and generator, the housing including air inlets and air outlets;

a fan drawing outside ambient air through the air inlets in the housing and along an inlet air pathway, the generator being axially disposed intermediate of the fan and the engine;

a heatsink attached to control electronics being disposed in the inlet air pathway;

the engine being liquid cooled, a flexible coolant fill tube having a pressure cap at its coolant fill end being interconnected to a coolant reservoir of the water cooled engine, the fill tube having a length sufficient to extend above the top of the housing when fully extended; and the housing including a side panel being pivotally mounted to allow pivotal movement of a top portion of the side panel away from the housing so as to allow access to the coolant fill tube.

* * * * *